United States Patent [19]

Ausnit

[11] Patent Number: 4,709,398

[45] Date of Patent: Nov. 24, 1987

[54] CHAIN BAGS, METHOD AND APPARATUS

[75] Inventor: Steven Ausnit, New York, N.Y.

[73] Assignee: Minigrip, Inc., Orangeburg, N.Y.

[21] Appl. No.: 1,050

[22] Filed: Jan. 7, 1987

[51] Int. Cl.[4] ..... B65D 33/16

[52] U.S. Cl. ..... 383/63; 383/37; 383/123; 493/214; 156/66

[58] Field of Search ..... 383/37, 63, 123, 65; 493/214; 156/66; 24/587

[56] References Cited

U.S. PATENT DOCUMENTS

| | | | |
|---|---|---|---|
| 3,744,211 | 7/1973 | Titchenal et al. | 383/65 |
| 3,779,139 | 12/1973 | White | 383/77 |
| 4,355,494 | 10/1982 | Tilman | 493/214 |
| 4,428,788 | 1/1984 | Kamp | 156/66 |
| 4,561,109 | 12/1985 | Herrington | 383/65 |
| 4,582,549 | 4/1986 | Ferrell | 493/214 |
| 4,630,310 | 12/1986 | Winesett | 383/37 |
| 4,655,862 | 4/1987 | Christoff et al. | 383/63 |

*Primary Examiner*—Willis Little

*Attorney, Agent, or Firm*—Hill, Van Santen, Steadman & Simpson

[57] ABSTRACT

A bag chain structure and method of making wherein fastener strips are attached across the surface of the film at predetermined intervals with the fastener strips having a plurality of rib and grooves so that the rib and grooves interlock when the strip is folded upon itself and the film is doubled so that the lateral edges are in adjacency and are joined, cross-seals are placed across the doubled film at intervals spaced from the fastener strips to form the bottom of the bag; and tear perforations are placed in the doubled film between the bottom seal and the fastener so that individual bags can be torn off of the continuous film sheet.

16 Claims, 4 Drawing Figures

5
10
11
12
13
13a
14
15
16
17
18
19
20
21
22
23
24
25
25a
26
27
27a
28
29
30
31
32
33
34
35
36
37

CHAIN BAGS, METHOD AND APPARATUS

BACKGROUND OF THE INVENTION

The present invention relates to improvements in the manufacture and structure of reclosable plastic film bags, and more particularly a method of making a chain of reclosable bags wherein the bags are attached to each other in end-to-end relationship. In the advance of the art of the manufacture of reclosable bags, developments have led to the manufacture of chain bags wherein a continuous series of bags are attached to each other along their side edges and in the direction of the reclosable fastener for drawing the chain through machines which open, fill and reclose them or wherein individual bags can be removed from the chains.

This type of reclosable bag conventionally has a zipper top provided with facing ribs and grooves which are interlocked when a closing pressure is applied to opposing surfaces of the bag top. The bags can be opened for filling and again closed so that the eventual consumer has a reclosable bag.

Side-by-side bags and chains have been frequently used in manufacture because manufacturing processes frequently lend themselves better to making side-by-side bags. For example when the reclosable strip at the top of the bag and the bags are formed by a single extrusion operation, the bags and the fastener emerge from the die at the same time and cross-sealing provides side-by-side bags. Up to the present, it has not been possible to provide a chain of reclosable bags, made on an automated basis, where the reclosable fastener runs across the machine direction of the film, and where the bags, instead of being attached in the fastener direction, are attached above and parallel to the fastener. For certain purposes, this type of chain is preferable.

It is accordingly an object of the present invention to provide a new and improved method of the manufacture of a chain of bags wherein the individual bags are attached to each other in endwise relationship and wherein the top of one bag is attached to the bottom of the next bag and wherein the reclosable fastener extends laterally across each of the bags of the continuous chain.

A further object of the invention is to provide an improved method and bag structure wherein a chain of bags is manufactured by a new and improved process with improved steps accommodating themselves to rapid manufacture and making it possible to make bags from a continuous flat sheet of film.

In accordance with the principles of the invention, a continuous sheet or strip of film is provided which is doubled or foldable over itself to form a continuous bag body so that the bag body can be cross-sealed at predetermined intervals to provide individual bag bodies. The lateral aligned edges of the folded film are joined to provide a side seam for the bag. Prior to folding the film, a zipper of unique construction is attached laterally across the bag and the zipper has a plurality of ribs and grooves which will interlock with each other when the zipper is doubled or folded upon itself along with the folding of the film. Zipper material of this nature is known from U.S. patent application, Ausnit, Ser. No. 812,467, Filed Dec. 23, 1985. Lateral attachment of zipper material to strips has been known from U.S. patent application, Christoff, Ser. No. 837,161, Filed Jan. 30, 1984 and its parent application, U.S. Ser. No. 574,878.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figures 1, 2, 3, 4:
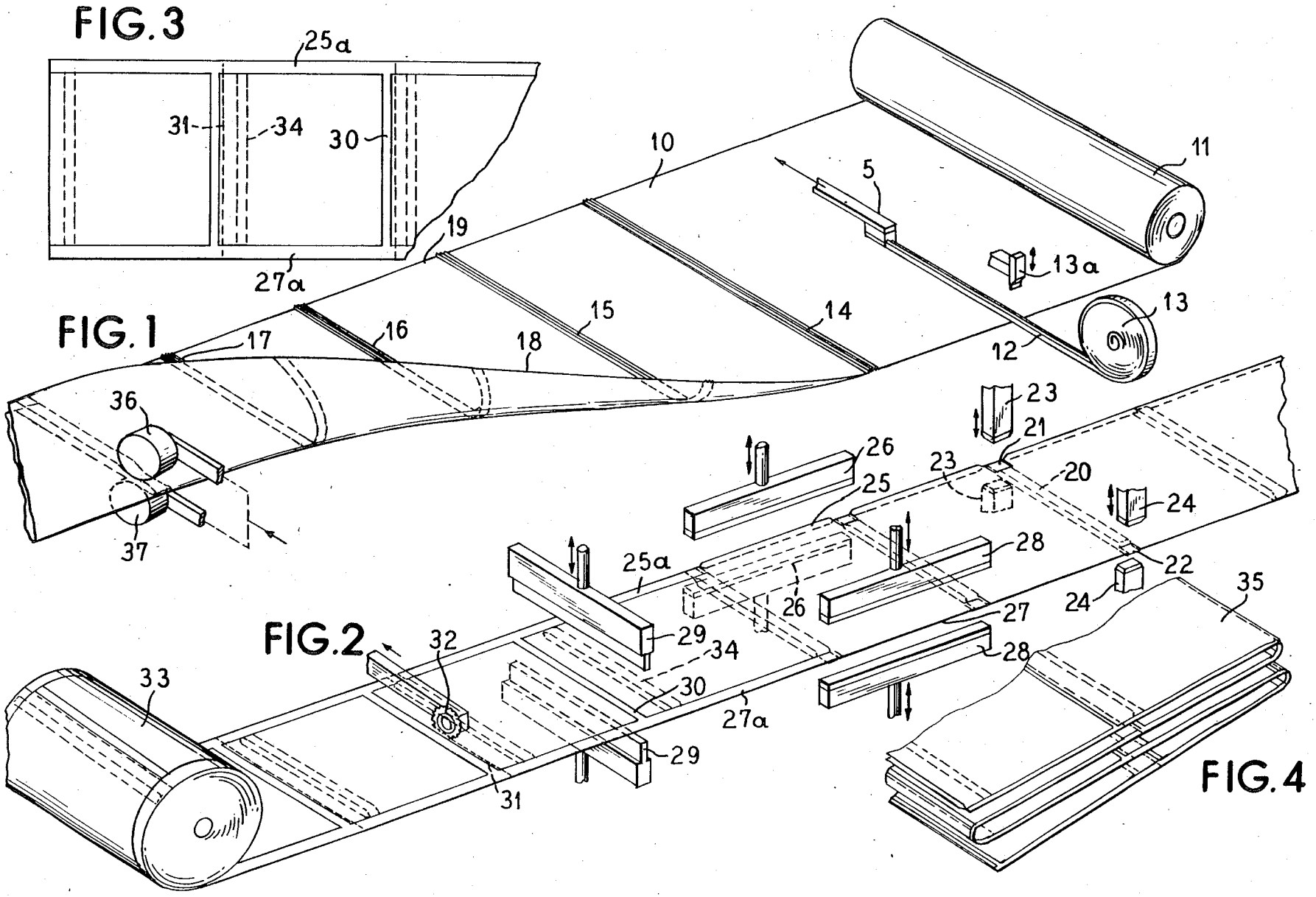
FIG. 1 is a somewhat schematic perspective view illustrating the beginning steps in the formation of bags from a continuous sheet of film.
FIG. 2 is another perspective view showing further steps in the formation of end-to-end bags.
FIG. 3 is a plan view illustrating a succession of end-to-end bags.
FIG. 4 is a fragmentary perspective view illustrating one form in which the bags may be stored.

As illustrated in FIG. 1, a continuous sheet of thin thermoplastic film is supplied from a roll 11. At predetermined spaced intervals, a zipper material 12 drawn from a supply roll 13 is drawn or pushed across the sheet 10 by mechanism 5 and secured to the face thereof. This zipper material may be adhesive backed or may be thermoplastic material similar to the film so that the edges or the base of the zipper can be sealed to the film by the application of heat. When a length of zipper material 12 is drawn across equal to the width of the film, it is cut by a knife 13*a*.

The zipper material is of thermoplastic and is of the type having a plurality of ribs and grooves such as the form illustrated in the aforementioned patent applications, Ser. Nos. 812,467 and 837,161. With this construction when the zipper material is folded on itself, or in other words, doubled, it will join to itself by the ribs entering the grooves. At the doubled edge, a slight lateral shifting of the ribs occurs to align them with the grooves.

The next step involves folding the sheet of film longitudinally by bringing its side edges 18 and 19 together into alignment or adjacency. This step in the method forms a tube with one side or in other words a continuous bag body which will form individual bag bodies as side and cross-seams are made. This doubling operation also doubles the zipper materials and the cross-zipper strips are shown at spaced intervals at 14, 15, 16 and 17 in FIG. 1 and at the locations 20 and 34 in FIG. 2.

To interlock or join the profiles of the doubled fastener strip, pressure rollers 36 and 37, FIG. 1, are rolled across the film laterally to press the ribs into the grooves and thus interlock the fastener. These rolls are indexed to mechanism 5. Aternately a pair of joining bars can be used to press the zipper between them.

The film shown in FIG. 2 is a continuation of the film of FIG. 1 and the doubled interlocked strip is shown at 20 with end spot seals being applied to the ends of the doubled film. These spot seals are shown at 21 and 22 for the doubled fastener strip 20 and are formed by heated spot upper and lower sealing elements 23 and 24 brought down against the thermoplastic film and zipper. This interlocks the joined profiles of the zipper so that they will remain in alignment when the bag which is formed is to be opened and reclosed.

The next succeeding step in the formation of the end-to-end bag chain, is to form side seams. The lateral edges of the film have been brought into alignment and are still separated and upper and lower heat sealing bars 26 are brought down against the edge of the film to form a side seam 25.

The other lateral edge of the film has been doubled and will form a side seam but to provide uniformity in appearance, the doubled edge 27 is also side seamed by bringing together upper and lower heating bars 28.

The film will be continued to be drawn forward for the next step which is the provision of bottom cross-seals for the bags. These bottom seals such as shown at 30 in FIGS. 2 and 3 are formed by bringing together upper and lower cross heat sealing bars 29. These bottom seams are made immediately above or in advance of the location of the cross-zippers and are, therefore, located at the same spaced intervals as the zippers.

The final step in the formation of the chain of end-to-end bags is to provide a strip of weakened tear resistance which in a preferred form is provided by perforations extending across the strip. These perforations shown at 31 can be made by drawing across a perforating wheel 32, also indexed to mechanism 5. The peforations are located close to the bottom seam of the previous bag and spaced slightly above the zipper to thereby provide opening flaps or lips above the zipper as individual bags are torn from the strip.

The foregoing sequence of steps can be formed at various work stations with the film material being drawn continually forward and being wound on a roll 33. For drawing the strip forward, the roll 33 may be driven in rotation. In some instances, it may be desirable to fold the end-to-end continuous strip of bags in lateral fold stacks such as illustrated at 35 in FIG. 4.

In operation, with reference to FIG. 1, continuous plastic film such as polyethylene is drawn off of a roll 11 and zipper strips such as 12, 14, 15 and 16 are attached across the film at predetermined spaced intervals. The film is then doubled on itself causing the zipper strips to be doubled with their surfaces confronting each other and these are interlocked by applying cross pressure, such as by rollers 36 and 37. End spot seals are then applied such as 21 and 22, and side seals are formed such as at 25 and 27. The bags are completed by providing a bottom seal 30 and tear strips at 31. Thus, a continuous chain of bags has been formed with the end of the chain having zippers at the top of each of the bags and as individual bags are torn off, a completed bag is provided with flaps at the top permitting opening of the individual bags. The method is well adapted to rapid fabrication of bags from a flat strip of film in a configuration not possible heretofore.

I claim as my invention:

1. A method of manufacture of reclosable bags comprising the steps:

applying a plurality of fastener strips each closable on itself laterally across the width of a continuous sheet of film at predetermined spaced intervals;

folding the film upon itself so that the opposed lateral edges are in alignment and with the fastener strips doubled and interlocking;

forming a seam joining said lateral edges to complete a body for bags;

forming lateral cross-seams at said spaced intervals spaced from the fastener strip with the cross-seam providing bag bottom seams;

and forming a line of weakened tear resistance at said spaced intervals located between each of the fastener strips and said bottom seam so that individual bags can be removed from the strip.

2. A method of manufacture of reclosable bags in accordance with the steps of claim 1:

including adding a seam at the opposite lateral edge to provide a bag body with seams at both lateral edges.

3. A method of manufacture of reclosable bags in accordance with the steps of claim 1:

wherein said film is of thermoplastic and said seam is formed by the application of a heated bar along the aligned lateral edges of the bag.

4. A method of manufacture of reclosable bags in accordance with the steps of claim 1:

wherein said fastener strips are drawn from a continuous supply with individual lengths removed from the supply.

5. A method of manufacture of reclosable bags in accordance with the steps of claim 4:

including means for forming spot seals at the ends of each of the doubled fastener strips.

6. A method of manufacture of reclosable bags in accordance with the steps of claim 1:

wherein said weakened tear resistance line is in the form of perforations extending through the film.

7. A method of manufacture of reclosable bags in accordance with the steps of claim 1:

wherein said fastener strips are of thermoplastic and heat seal end tacks are made at each end of the doubled strips.

8. The method of manufacture of reclosable bags comprising the steps:

attaching a fastener strip closable on itself laterally across the width of a sheet of film so that the strip extends from one edge of the film to the other;

folding the film laterally upon itself so that the fastener strip is doubled and interlocked and so that opposed lateral edges of the film are in alignment;

and forming a seam joining said lateral edges.

9. The method of manufacture of reclosable bags in accordance with the steps of claim 8:

wherein said film and said strip are of thermoplastic material and a heat seal tack is formed at the ends of the doubled strip for aligning reclosable fastener rib and groove elements along the strip.

10. A bag chain structure comprising in combination:

a continuous sheet of film folded on itself so that the lateral edges are in adjacency to form continuous bag bodies;

seam means joining said adjacent lateral edges to each other;

a fastener strip having matched interlocking rib and groove elements on one surface with the surface forming opposed surfaces by the strip being doubled with the folding of the film;

bottom seals above each of said doubled fastener strips for forming the base of an adjoining bag;

and lateral lines of weakened tear resistance between the fastener strip and the bottom seal for removal of individual bags from the continuous bag bodies.

11. A bag chain structure constructed in accordance with claim 10:

wherein said film and fastener strip are of thermoplastic material and heat seal end spots are at the ends of the doubled fastener strip.

12. A bag chain structure constructed in accordance with claim 10:

including a second seam means along the adjacent doubled lateral edge of the bag body.

13. A bag chain structure constructed in accordance with claim 10:

wherein said line of weakened tear resistance is in the form of perforations through the film.

14. A bag chain structure constructed in accordance with claim 10:

wherein said film is of thermoplastic and a spot seal is located at the ends of the doubled fastener strip.

15. A bag structure comprising in combination:

a sheet of film folded on itself so that the lateral edges are in adjacency with the lateral edges being joined to form a side seam;

and a fastener strip on the inner surface of the folded film doubled on itself with said fastener strip having a surface containing a plurality of rib and groove elements correspondingly shaped and sized so that with doubling of the fastener strip the rib elements enter the groove elements to form a reclosable interlock for the top of a bag formed by said folding, the ends of said fastener strip extending to the edges of said film sheet.

16. A bag structure in accordance with claim 15:

wherein the film and fastener strip are of thermoplastic and spot seals are formed at each end of the doubled fastener strips aligning the rib and grooves.

* * * * *